US009634402B2

(12) United States Patent
Zavrel, Jr.

(10) Patent No.: US 9,634,402 B2
(45) Date of Patent: Apr. 25, 2017

(54) POLARIZATION DIVERSITY IN ARRAY ANTENNAS

(71) Applicant: Trimble Navigation Limited, Sunnyvale, CA (US)

(72) Inventor: Robert Joseph Zavrel, Jr., Elmira, OR (US)

(73) Assignee: Trimble Inc., Sunnyvale, CA (US)

( * ) Notice: Subject to any disclaimer, the term of this patent is extended or adjusted under 35 U.S.C. 154(b) by 31 days.

(21) Appl. No.: 14/722,020

(22) Filed: May 26, 2015

(65) Prior Publication Data

US 2016/0268695 A1 Sep. 15, 2016

Related U.S. Application Data

(60) Provisional application No. 62/130,499, filed on Mar. 9, 2015.

(51) Int. Cl.

| | |
|---|---|
| ***H01Q 3/24*** | (2006.01) |
| ***H01Q 21/00*** | (2006.01) |
| ***H01Q 1/22*** | (2006.01) |
| ***H01Q 7/00*** | (2006.01) |
| ***H01Q 9/04*** | (2006.01) |
| ***H01Q 21/24*** | (2006.01) |

(52) U.S. Cl.

CPC ..... *H01Q 21/0006* (2013.01); *H01Q 1/2216* (2013.01); *H01Q 7/00* (2013.01); *H01Q 9/045* (2013.01); *H01Q 21/24* (2013.01)

(58) Field of Classification Search

CPC ..... H01Q 21/0006; H01Q 7/00; H01Q 21/24; H01Q 1/2216; H01Q 9/045

USPC ..... 343/876

See application file for complete search history.

(56) References Cited

U.S. PATENT DOCUMENTS

| | | | | |
|---|---|---|---|---|
| 6,411,824 | B1 * | 6/2002 | Eidson | H04B 7/10 342/361 |
| 7,804,455 | B2 * | 9/2010 | Lee | H01Q 1/2216 340/572.7 |
| 8,174,391 | B2 * | 5/2012 | Sandler | H01Q 1/2216 340/10.1 |

* cited by examiner

*Primary Examiner* — Brian Young

(74) *Attorney, Agent, or Firm* — Kilpatrick Townsend & Stockton LLP

(57) ABSTRACT

An array antenna includes at least two antenna elements that are axially-aligned and axially-spaced. Polarization diversity is provided by at least one driven antenna element that provides horizontal and vertical polarizations. The driven element includes one or more feed points for the horizontal polarization and one or more feed points for the vertical polarization. A switching circuit is configured to switch between the one or more feed points to alternately provide the horizontal and vertical polarizations.

20 Claims, 11 Drawing Sheets

Top View

Bottom View

POLARIZATION DIVERSITY IN ARRAY ANTENNAS

CROSS REFERENCE TO RELATED APPLICATIONS

This application claims priority to U.S. Provisional Application No. 62/130,499, filed Mar. 9, 2015, the entire contents of which are incorporated herein by reference for all purposes.

FIELD OF THE INVENTION

Embodiments described herein relate generally to polarization diversity in array antennas, and more specifically, to polarization diversity in patch array and linear array antennas.

BACKGROUND

An isotropic antenna transmits and/or receives power in all directions equally. Such an antenna is considered to have an isotropic pattern or directivity of 1 (0 dBi). An isotropic antenna has no preferred direction of radiation. If an antenna is non-isotropic, then the response will favor one or more directions over others. In the favored directions, the directivity will be more than 1 (>0 dBi), and in the non-favored directions, the directivity will be less than 1 (<0 dBi).

A term that is useful in defining antenna performance is gain. The gain (G) of an antenna is determined by its directivity (D) multiplied by its efficiency:

$$G=D\times\text{efficiency} \quad (1)$$

As antenna size is reduced relative to operating wavelength (A), efficiency will typically decrease and thus gain will also decrease. This makes building small antennas with adequate gain a challenge. There are several techniques for increasing antenna gain. Some of the techniques include building a larger antenna and/or building an antenna inside a high dielectric material. The high dielectric material slows the speed of light around the antenna, effectively making the antenna perform as if it were larger.

Using multiple antennas (or elements) is another technique for increasing antenna gain. Two basic antenna configurations that include multiple elements are broadside and end-fire array antennas. In a broadside array, the elements are arranged on a plane and maximum directivity is along a direction normal to the plane. An example of a four-element broadside array is shown in FIG. 1. In an end-fire array, the elements are arranged axially and maximum directivity is along a direction parallel to the axis. An example of a four-element end-fire array is shown in FIG. 2. In both the broadside and end-fire arrays, all elements are driven (or connected to a radio). A parasitic array is another antenna configuration that includes multiple elements, but in a parasitic array, at least one element is driven and at least one element is not driven (or not connected to a radio).

Improved antenna designs and configurations are constantly sought to increase gain based on the specific requirements of particular applications.

SUMMARY

Embodiments described herein provide polarization diversity in array antennas. This can increase gain over conventional broadside, end-fire, or parasitic array antennas. The increased gain can improve device performance in some applications.

In accordance with an embodiment, an array antenna includes at least two antenna elements. Each antenna element of the at least two antenna elements may be axially-aligned and axially-spaced by about λ/4 from adjacent ones of the at least two antenna elements. Polarization diversity is provided by at least one driven antenna element of the at least two antenna elements. The at least one driven antenna element provides horizontal and vertical polarizations. The at least one driven antenna element includes one or more feed points for the horizontal polarization and one or more feed points for the vertical polarization. A switching circuit is configured to switch between the one or more feed points to alternately provide the horizontal and vertical polarizations.

In an embodiment, a phase shifter may be configured to shift the phase of at least one signal so that signals from adjacent ones of the at least two antenna elements are shifted by about 90°.

In another embodiment, a combiner may be configured to combine received signals into a single signal and provide the single signal to a receiver.

In some embodiments, the at least two antenna elements may include at least one patch antenna element. In other embodiments, the at least two antenna elements may include at least one linear antenna element.

In some embodiments, the at least two antenna elements may be substantially aligned and/or include more than one driven antenna element each of which is fed in-phase.

In yet other embodiments, the at least two antenna elements may include one or more parasitic antenna elements that are free from connection to other circuitry.

In accordance with another embodiment, a patch array antenna includes at least two antenna elements. Each antenna element of the at least two antenna elements may be axially-aligned and axially-spaced by about λ/4 from adjacent ones of the at least two antenna elements. Polarization diversity is provided by at least one driven antenna element of the at least two antenna elements. The at least one driven antenna element provides horizontal and vertical polarizations. The at least one driven antenna element includes one or more feed points for the horizontal polarization and one or more feed points for the vertical polarization. A switching circuit is configured to switch between the one or more feed points to alternately provide the horizontal and vertical polarizations.

In an embodiment, the at least two antenna elements may include one or more linear antenna elements.

In accordance with yet another embodiment, a linear array antenna includes at least two antenna elements. Each antenna element of the at least two antenna elements may be axially-aligned, axially-spaced, and/or include a number of substantially linear conductive segments forming a loop. Polarization diversity is provided by at least one driven antenna element of the at least two antenna elements. The at least one driven antenna element provides horizontal and vertical polarizations. The at least one driven element includes one or more feed points for the horizontal polarization and one or more feed points for the vertical polarization. An inductor is disposed at each corner of the loop. A switching circuit is configured to switch between the one or more feed points to alternately provide the horizontal and vertical polarizations.

In an embodiment, the at least two antenna elements may include one or more linear antenna elements.

In some embodiments of both the patch and linear array antennas, one or more of the elements may be a parasitic element (not driven). The parasitic element does not include feed points and/or is not connected to other circuitry. Instead, the parasitic element becomes part of the antenna array through mutual impedance between the parasitic element and one or more driven elements by virtue of proximity. Using a parasitic element provides an increase in gain over a single element antenna while providing a simpler feed structure than a patch or linear array antenna using all driven elements.

Numerous benefits are achieved using embodiments described herein over conventional antennas. For example, in some embodiments, antenna gain can be increased using the patch array and linear array antennas described herein. In some devices, such as radio frequency identification (RFID) readers, the increased gain can increase read range and/or reduce operating power. A reduced operating power can increase battery life. Also, in some embodiments, the patch array and linear array antennas described herein can be provided in a cylindrical form factor that is narrower than conventional antennas having similar gain. This can be beneficial for devices such as RFID readers. Depending on the embodiment, one or more of these benefits may exist. These and other benefits are described throughout the specification with reference to the drawings.

DETAILED DESCRIPTION

Embodiments described herein provide polarization diversity in array antennas. The polarization diversity can increase gain and improve performance in some applications. The polarization diversity is provided by at least one driven element that provides horizontal and vertical polarization. The multiple elements can further increase gain. The multiple elements include at least one driven element, and in some embodiments, they may also include at least one parasitic element.

Figure 1:
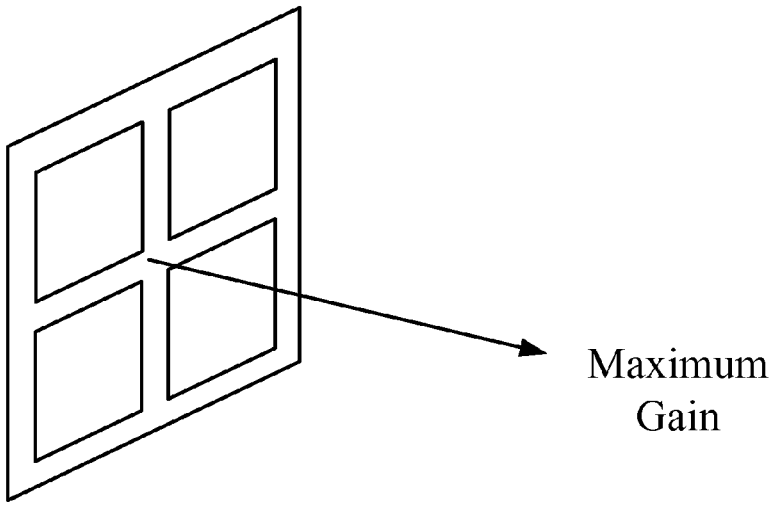
FIG. 1 is a simplified diagram of a four-element broadside array antenna.
Figure 2:
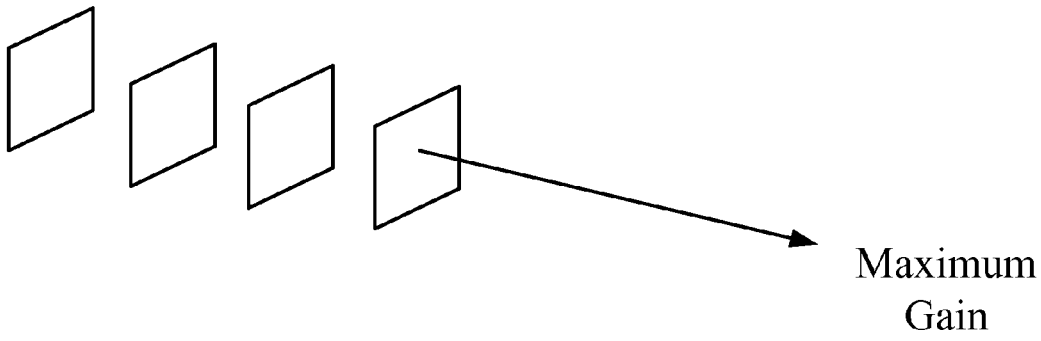
FIG. 2 is a simplified diagram of a four-element end-fire array antenna.
Figure 3A:
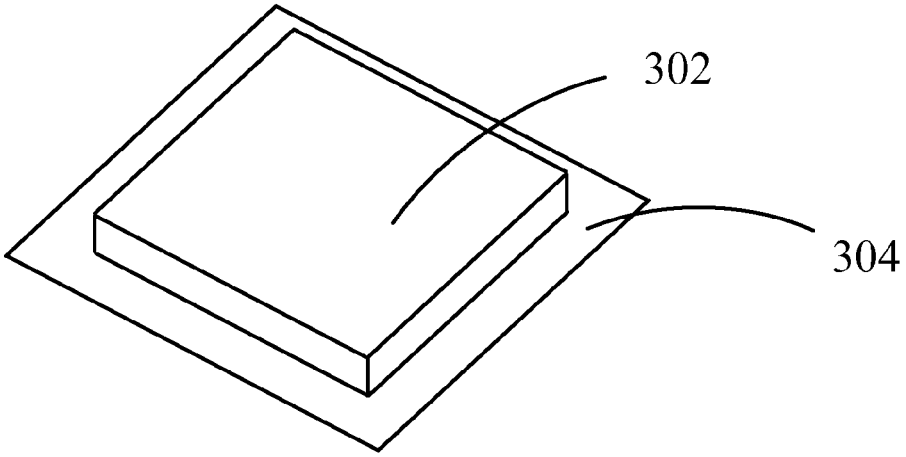
FIGS. 3A-3B are simplified diagrams showing top and bottom views of a patch antenna.
Figure 3B:
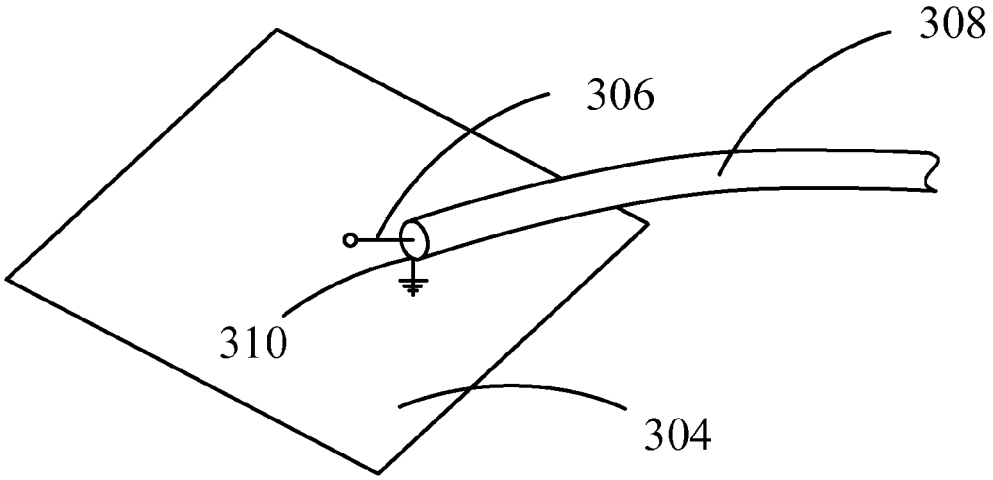

FIGS. 3A-3B are simplified diagrams showing top and bottom views respectively of a patch (or microstrip) antenna. A patch antenna typically includes a flat metal sheet (or element) 302 mounted over a larger metal ground plane 304. The element 302 usually has a rectangular shape, although other shapes may be utilized, and the metal layers 302, 304 are generally separated using a dielectric spacer. The element 302 typically has a length of approximately $\lambda/2$.

Patch antennas can be configured to provide linear or circular polarization depending on the location of a feed point. FIG. 3B shows a feed line (e.g., a coaxial cable) 308 having a core 306 that passes through the ground plane 304. The feed line 308 also includes a ground (or shield) 310 that is coupled to the ground plane 304. An opposite end of the feed line 306 is coupled to a radio (e.g., a receiver and/or a transmitter). Although not shown, the core 306 passes through the dielectric spacer and is coupled to the element 302. The feed point is the point where the core 306 and element 302 are coupled.

Figure 4:
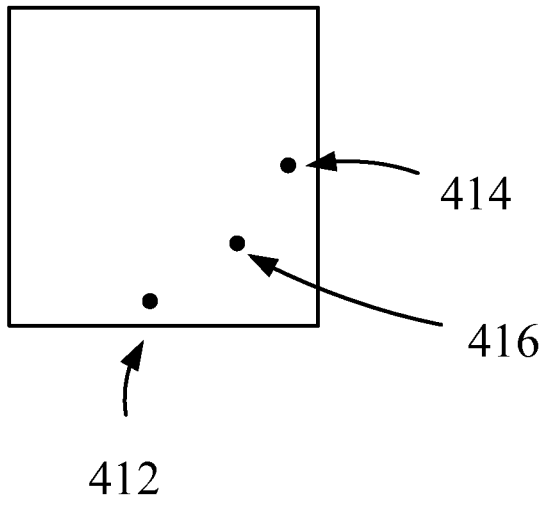
FIG. 4 is a simplified diagram of an antenna element showing different feed points for providing horizontal, vertical, or circular polarization.

FIG. 4 is a simplified diagram of an antenna element showing different feed points for providing horizontal, vertical, or circular polarization. The feed point 412 is near a horizontal edge of the element for providing horizontal polarization, the feed point 414 is near a vertical edge of the element for providing vertical polarization, and the feed point 416 is between the horizontal and vertical edges for providing circular polarization. In some embodiments, the core may wrap around the dielectric and/or ground plane rather than pass through the dielectric and ground plane.

Figure 5:
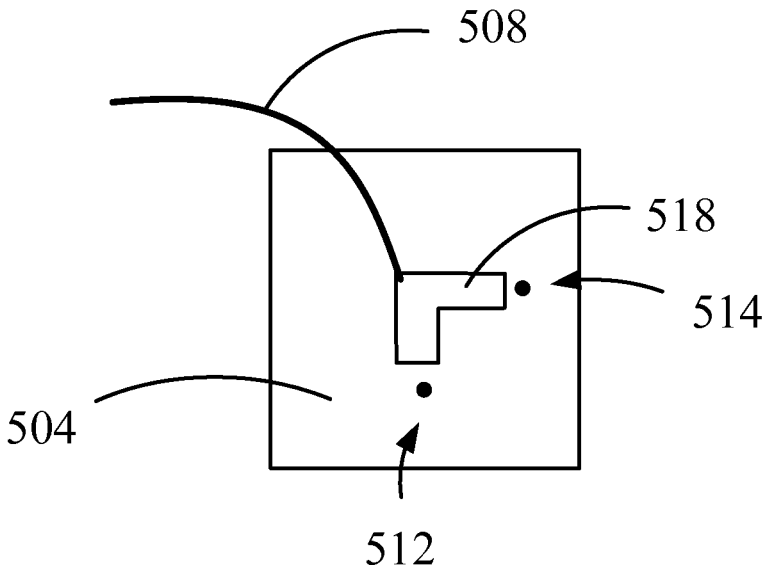
FIG. 5 is a simplified diagram showing a bottom view of an array antenna with a switching circuit in accordance with an embodiment.

FIG. 5 is a simplified diagram showing a bottom view of an array antenna with a switching circuit 518 in accordance with an embodiment. Although not specifically shown, the feed line 508 in this example may include a core that is coupled to the switching circuit 518 and a ground that is coupled to the ground plane 504. The ground may be coupled directly to the ground plane 504 or coupled to the ground plane 504 via the switching circuit 518. The switching circuit 518 is configured to switch between feeds for horizontal 512 and vertical 514 polarization. The feeds are coupled to a driven element (not shown) at appropriate feed points to provide the horizontal and vertical polarizations.

As shown in FIG. 5, the switching circuit 518 may be mounted on the ground plane 504 in some embodiments. In other embodiments, the switching circuit 518 may be mounted on another board. The switching circuit 518 may include a circuit on a printed circuit board (PCB), a solid state switch, a micro-mechanical switch, or the like. The switching circuit 518 may be controlled by a DC voltage applied through the feed line 508 (e.g., a 50 ohm feed line). The switching circuit 518 may be synchronous or asynchronous with an associated device (e.g., a receiver and/or transmitter). In some embodiments, the switching time may be between about 1 ms and 1 s (or about 400 to 600 ms in an embodiment).

Figure 6A:
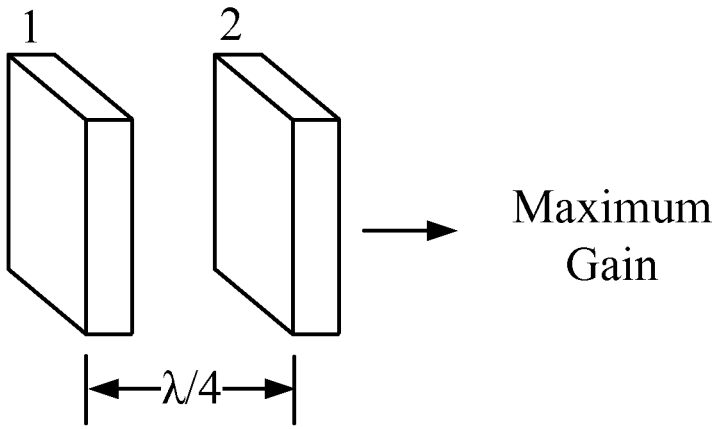
FIGS. 6A-6B are simplified diagrams of a patch array antenna in accordance with an embodiment.
Figure 6B:
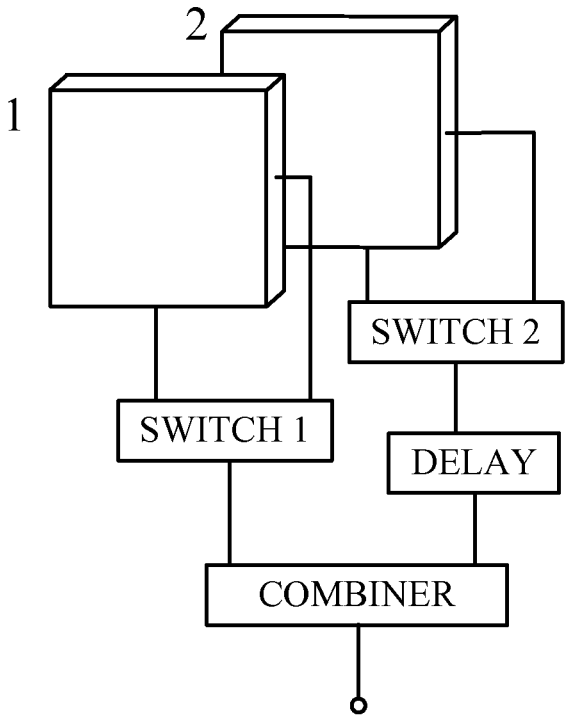

FIGS. 6A-6B are simplified diagrams of a patch array antenna in accordance with an embodiment. The patch array antenna in this example includes two elements, although any number of elements may be used in accordance with the various embodiments described herein. FIG. 6A is a side view showing that the elements are spaced by approximately λ/4. In this example, the elements are not rotated relative to each other (sides providing horizontal polarization are aligned and sides providing vertical polarization are aligned). In other embodiments, the spacing may be more or less than λ/4 and/or one element may be rotated relative to another element. The specific configuration of the patch array antenna may depend on the operating conditions and intended application.

In this example, both of the elements are driven by individual feed lines. Also, both elements include feed points for providing horizontal and vertical polarization, and both elements include a switching circuit for switching between the horizontal and vertical polarizations. A combiner may include a phase shifter or delay to shift the phase of at least one signal so that signals from adjacent elements are shifted by about 90°. This is to account for the spacing between the elements so that signals can be constructively combined. The switching circuits, combiner, and phase shifter or delay are illustrated in FIG. 6B. In some embodiments, the phase shifter or delay may be provided as a separate component coupled to only one of the elements. The feed lines from each patch are coupled to the combiner where individual signals are combined and sent to a receiver. In a similar but reciprocal manner, a single signal from a transmitter may be split at a splitter into two or more signals. In some embodiments, the splitting may be performed at the same element as the combining. The phase shifter or delay may shift the phase of at least one signal so that signals to adjacent elements are shifted by about 90°. The signals may be transmitted by the patch array antenna.

Figure 7:
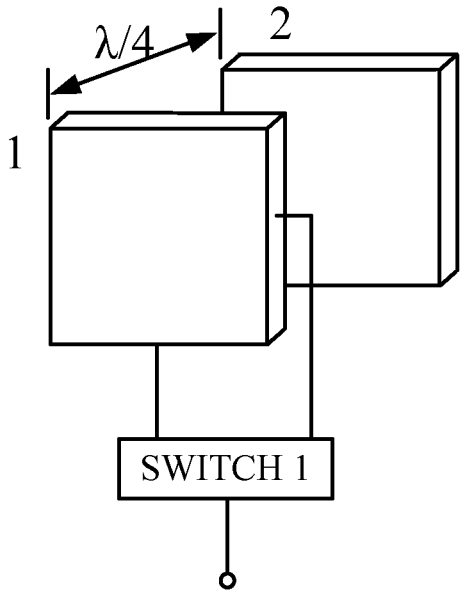
FIG. 7 is a simplified diagram of a patch array antenna with a parasitic element in accordance with an embodiment.

FIG. 7 is a simplified diagram of a patch array antenna with a parasitic element in accordance with an embodiment. This example includes two elements that can be spaced and arranged in a manner similar to the embodiment shown in FIGS. 6A-6B. In this example, the front element (1) is driven and the back element (2) is parasitic. Depending on operating requirements, in some embodiments the front element could be parasitic and the back element driven. The driven element is coupled to a feed line and includes feed points for providing horizontal and vertical polarization. The driven element also includes a switching circuit for switching between the horizontal and vertical polarizations. The parasitic element does not require switching but instead responds to the polarization defined by the driven element.

Figure 8:
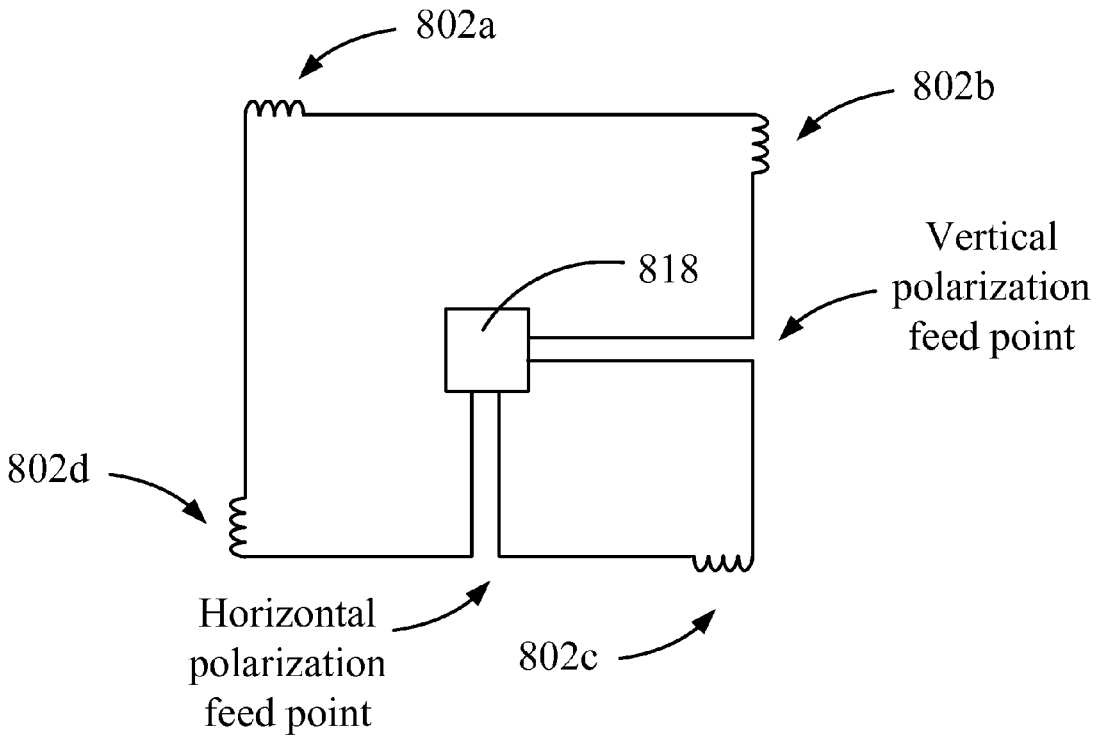
FIG. 8 is a simplified diagram of an element of a linear array antenna in accordance with an embodiment.

FIG. 8 is a simplified diagram of an element of a linear array antenna in accordance with an embodiment. The element includes a number of substantially linear segments that form a loop. The substantially linear segments include wires in this example, and the substantially linear segments in the example shown in FIG. 9 include conductive lines (or traces). The conductive lines may be formed using conventional printed circuit board assembly (PCBA) processes. The total length of the loop is about one λ (or about λ/4 per side). The length of the substantially linear segments can be reduced by including inductors at corners of the loop. In FIG. 8, the inductors include coils (802*a*, 802*b*, 802*c*, 802*d*), and in FIG. 9, the inductors include surface mount components (902*a*, 902*b*, 902*c*, 902*d*). Different inductance values can be used for directors and reflectors as well as for reception and/or transmission at different frequency bands. The inductors maintain gain symmetry for both horizontal and vertical polarizations while shrinking the cross-sectional area of the antenna. The inductors can reduce physical size, but they also reduce bandwidth and gain. The reduced gain can be offset by including additional elements in the array. However, the additional elements increase axial length (inductors reduce cross-sectional area and additional elements increase axial length). A switching circuit (818 in FIG. 8 or 918 in FIG. 9) is provided to switch between the feed points to alternately provide the horizontal and vertical polarizations. Transmission lines or feeders extend between terminals of the switching circuit and the feed points.

Figure 10:
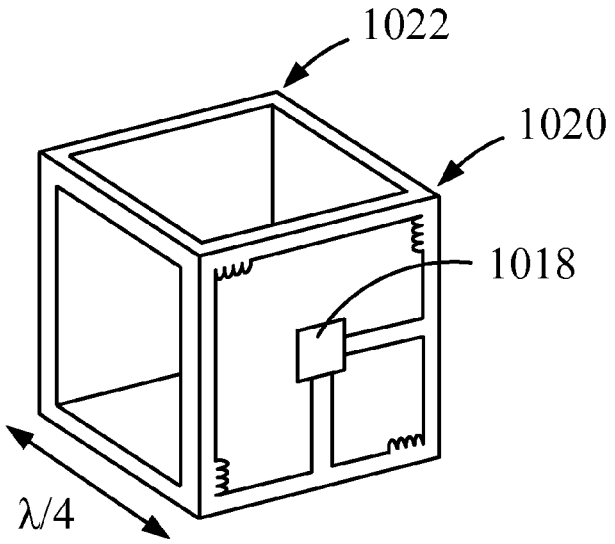
FIG. 10 is a simplified diagram of a linear array antenna in accordance with an embodiment.

FIG. 10 is a simplified diagram of a linear array antenna in accordance with an embodiment. Like patch array antennas, each element of a linear array antenna is spaced by about λ/4 from adjacent elements, and the space between them is filled with air or one or more other dielectrics (or at least partially filled by parts of a structure fixing the elements in place relative to each other). In some embodiments, like the example shown in FIG. 10, a linear array antenna may include a single element 1020 separated from another element 1022. The other element may be, for example, another linear element or a patch antenna. In other embodiments, a linear array antenna may include an array of linear elements with one or more patch antennas, while in still other embodiments, a linear array antenna may include an array of linear elements without any patch antennas.

Figure 9:
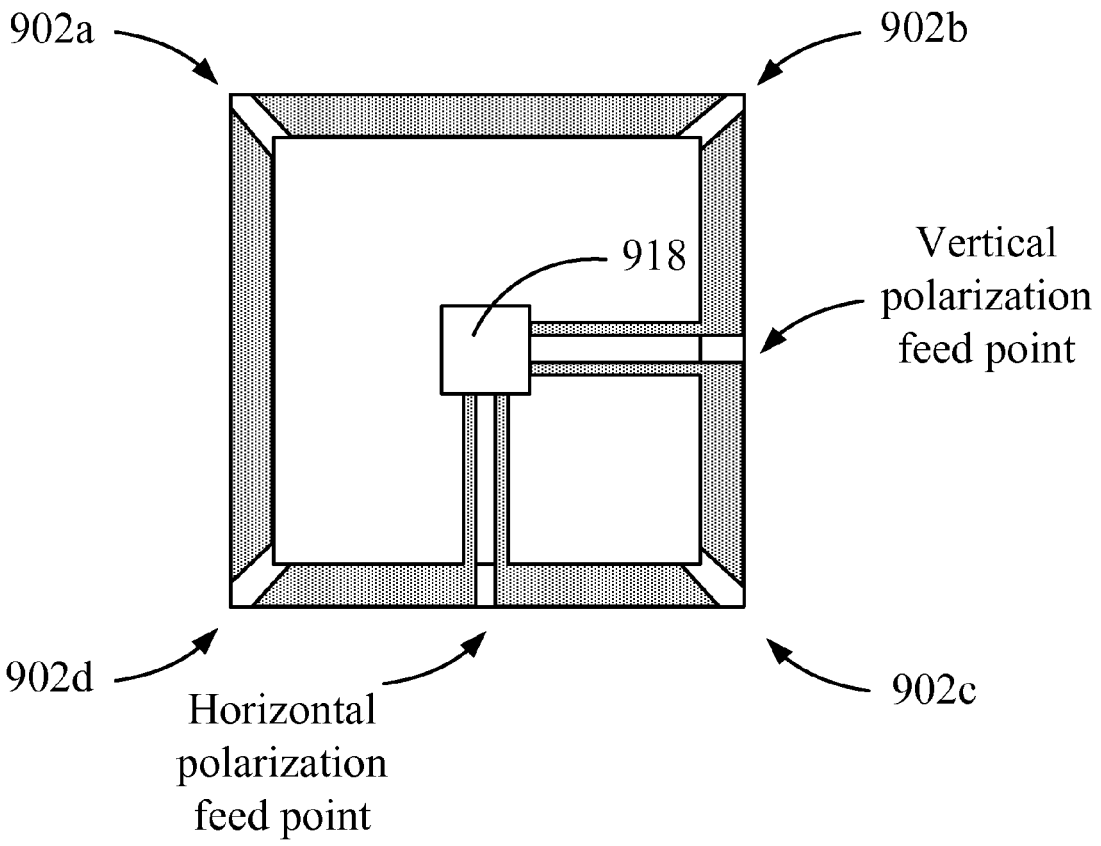
FIG. 9 is a simplified diagram of an element of a linear array antenna in accordance with another embodiment.
Figure 11:
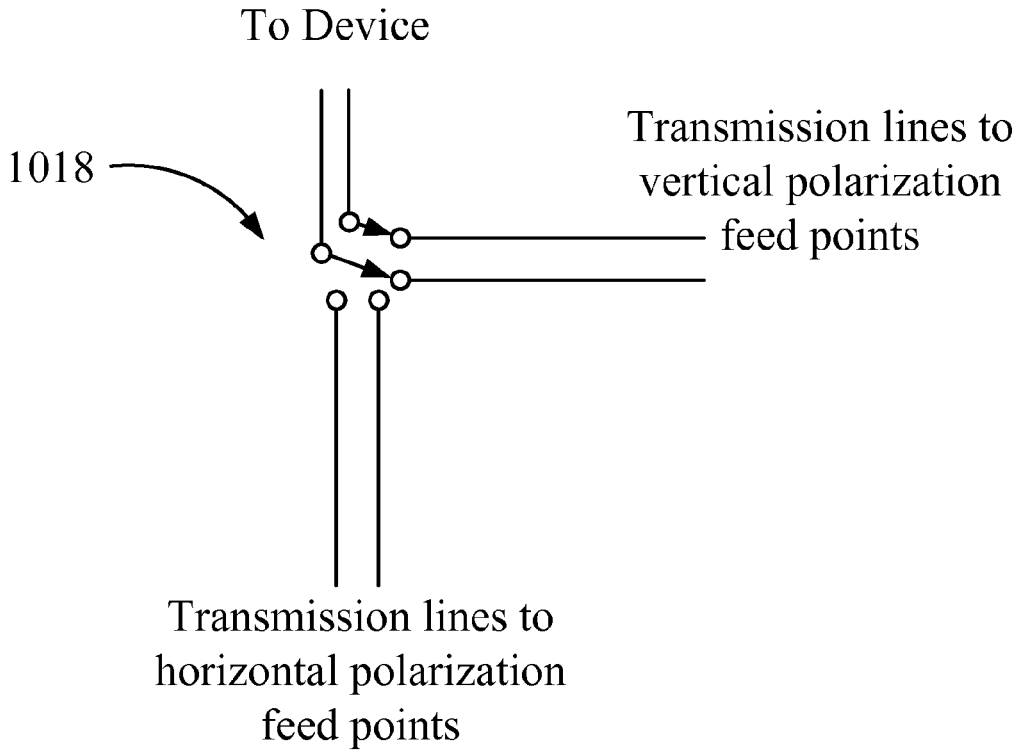
FIG. 11 is a simplified diagram showing the switching in a linear array antenna in accordance with an embodiment.

The polarization diversity in a linear array antenna is provided by at least one driven element that provides horizontal and vertical polarization. The driven element includes a feed point for horizontal polarization and a feed point for vertical polarization as shown in FIGS. 8-9. A switching circuit 1018 is provided. As shown in FIG. 11, the switching circuit 1018 is configured to switch between the feed points to alternately provide the horizontal and vertical polarizations. Transmission lines or feeders extend between terminals of the switching circuit and the feed points. In some embodiments, the elements may be aligned (little or no relative rotation) and/or fed in-phase. A phase shifter or delay may be provided to shift the phase of signals associated with at least one of the elements by about 90° relative to signals associated with adjacent elements. A combiner may be provided to combine received signals into a single signal that can be provided to a receiver. In a similar but reciprocal manner, a single signal from a transmitter may be split at a splitter into two or more signals. In some embodiments, the splitting may be performed at the same element as the combining. The phase shifter or delay may shift the phase of at least one signal so that signals to adjacent elements are shifted by about 90°. The signals may be transmitted by the linear array antenna.

Figure 12:
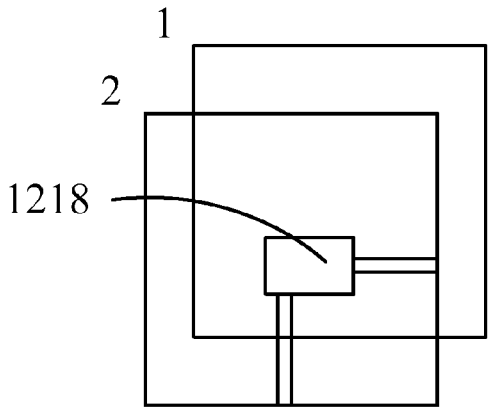
FIG. 12 is a simplified diagram of a linear array antenna with a parasitic element in accordance with an embodiment.

FIG. 12 is a simplified diagram of a linear array antenna with a parasitic element in accordance with an embodiment In this example, the rear element (2) is driven and the front element (1) is parasitic (although the rear element could be parasitic and the front element driven in other embodiments). The parasitic element (1) may use more or less inductance depending on reflector or director configuration. The driven element is coupled to a feed line and includes feed points for providing horizontal and vertical polarization (similar to the embodiments illustrated in FIGS. 8-9). A switching circuit 1218 is also provided for switching between the horizontal and vertical polarizations.

Figure 13:
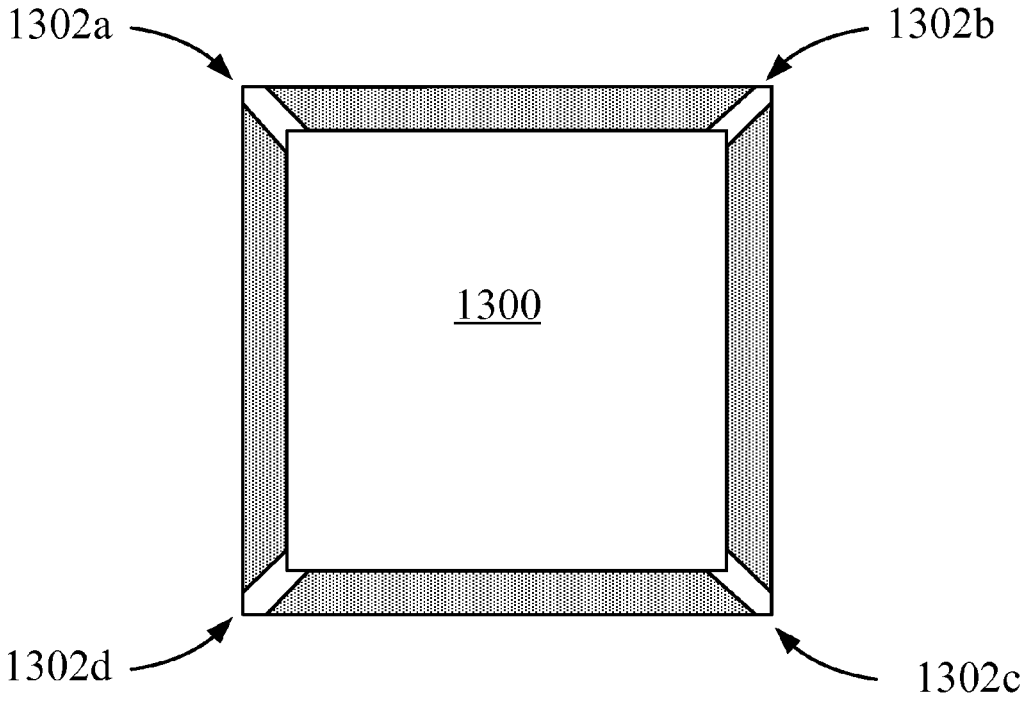
FIG. 13 is a simplified diagram of a parasitic element for a linear array antenna in accordance with an embodiment.

FIG. 13 is a simplified diagram of a parasitic element 1300 for a linear array antenna in accordance with an embodiment. In this example, the substantially linear segments include conductive lines (or traces), and the inductors include one or more surface mount components (1302*a*, 1302*b*, 1302*c*, 1302*d*). The conductive lines may be formed using conventional PCBA patterning techniques.

In the patch array and linear array antennas described herein, the switching circuit may be coupled to the transmission lines or feeders using any of a number of different configurations. In some linear array antenna embodiments, the switching circuit may include a conventional dual pole, double throw (DPDT) switch. The switching circuit allows the transmission line corresponding to the desired polarization to be connected to a feed line and the other transmission line left open. The unused transmission line presents a short on the element, effectively rendering the unused transmission line as an impedance-transforming switch. The unused transmission line effectively disappears as far as the antenna is concerned. In other array antenna embodiments, the switching circuit may include a conventional single pole, double throw (SPDT) switch. A SPDT switch is typically used when the feed line includes a coaxial cable or some other unbalanced line.

Figure 14:
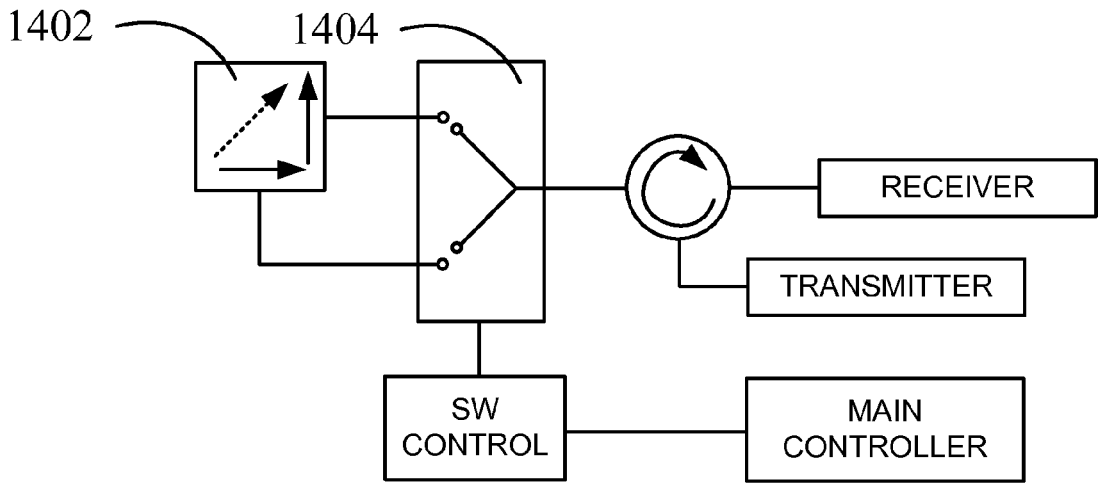
FIG. 14 is a simplified block diagram of a device using a patch array or linear array antenna in accordance with an embodiment.

FIG. 14 is a simplified block diagram of a device using a patch array or linear array antenna in accordance with an embodiment. This figure shows horizontally polarized signals and vertically polarized signals received at an array antenna 1402. A switching circuit 1404 switches between the horizontal and vertical polarizations. The switching circuit 1404 shown is merely an example to convey the switching concept. Actual switching circuits known in the art are more complex than this simplified example. The switching circuit 1404 may be under software control of a main controller in accordance with known techniques. Embodiments that include multiple elements may include a phase shifter or delay to shift the phase of at least one signal so that signals from adjacent elements are shifted by about 90°. A combiner combines the signals into a single signal that is provided to a receiver. In a reverse manner, signals generated by a transmitter are split and emitted from the array antenna with horizontal and vertical polarizations.

One device that benefits from use of the patch array and linear array antennas described herein is an RFID reader. RFID readers typically use circular polarization (CP). CP provides an equal response regardless of the relative orientation between the RFID reader and the RFID tag. This is because some components of the CP will always be in-phase, while other components of the CP will always be out-of-phase. While CP provides an equal response, gain is reduced by about 3 dB due to the out-of-phase components.

Figure 15:
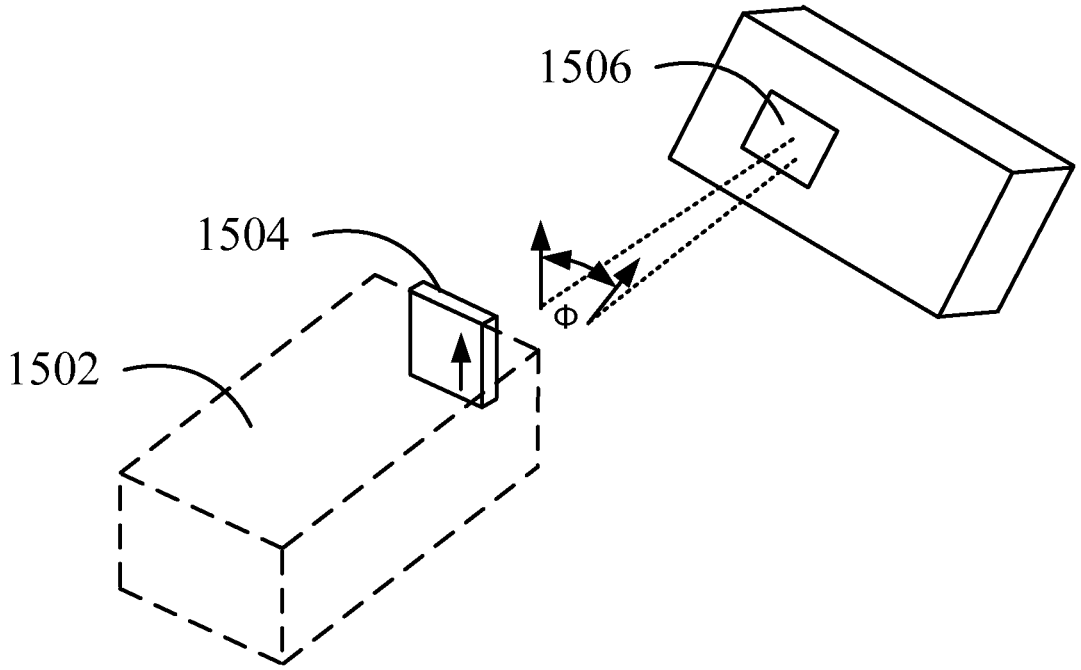
FIG. 15 is a simplified diagram of an RFID reader interrogating an RFID tag in accordance with an embodiment

This 3 dB loss can be recovered by using one of the patch array or linear array antennas described herein. This can be illustrated with reference to the example shown in FIG. 15. This example shows that received power is reduced when only horizontal polarization or only vertical polarization is used. An RFID reader 1502 has an antenna 1504 that is misaligned with an RFID tag 1506. In this example, only vertical polarization is used when transmitting, and received power is $\cos^2\theta$. Similarly, if only horizontal polarization were used when transmitting, received power would be $\sin^2\theta$. In contrast, using both horizontal and vertical polarizations maximizes received power ($\cos^2\theta+\sin^2\theta=1$). The gain can be further increased by using multiple elements as described above.

Current market demands on RFID readers are to maximize read range and extend battery life. The United States Federal Communications Commission (FCC) limits power output from an RFID reader to 1 watt and antenna gain to 6 dBi. This limits performance of an RFID reader operating in the 902-928 MHz band to 4 watts equivalent isotropically radiated power (EIRP)—assuming a polarization that is a perfect complement to the orientation of the RFID tag. 4 watts EIRP can be achieved with an output power of 1 watt and an antenna gain of 6 dBi, or with a lower output power and a higher antenna gain.

The read range can be maximized and the battery life can be extended using the patch array or linear array antennas described herein. As explained above, the 3 dB loss from CP can be gained using embodiments that provide both horizontal and vertical polarizations. Increasing antenna aperture by using additional elements can increase gain by at least another 3-7 dB. This can allow an RFID reader to operate at the 4 watt EIRP limit (maximize read range) while reducing output power below 1 watt (extend battery life).

It should be appreciated that some embodiments may be implemented by hardware, software, firmware, middleware, microcode, hardware description languages, or any combination thereof. When implemented in software, firmware, middleware, or microcode, the program code or code segments to perform the necessary tasks may be stored in a computer-readable medium such as a storage medium. Processors may be adapted to perform the necessary tasks. The term "computer-readable medium" includes, but is not limited to, portable or fixed storage devices, optical storage devices, wireless channels, sim cards, other smart cards, and various other non-transitory mediums capable of storing, containing, or carrying instructions or data.

While the present invention has been described in terms of specific embodiments, it should be apparent to those skilled in the art that the scope of the present invention is not limited to the embodiments described herein. For example, features of one or more embodiments of the invention may be combined with one or more features of other embodiments without departing from the scope of the invention. The specification and drawings are, accordingly, to be regarded in an illustrative rather than a restrictive sense. Thus, the scope of the present invention should be determined not with reference to the above description, but should be determined with reference to the appended claims along with their full scope of equivalents.

What is claimed is:

1. An array antenna comprising:

at least two antenna elements, each antenna element of the at least two antenna elements being axially-aligned and axially-spaced by about $\lambda/4$ from adjacent ones of the at least two antenna elements, wherein polarization diversity is provided by one or more driven antenna elements of the at least two antenna elements, each of the one or more driven antenna elements providing horizontal and vertical polarizations, each of the one or more driven antenna elements including one or more feed points for the horizontal polarization and one or more feed points for the vertical polarization;

a switching circuit configured to switch between the one or more feed points to alternately provide the horizontal and vertical polarizations;

a phase shifter configured to shift the phase of at least one signal so that signals from adjacent ones of the at least two antenna elements are shifted by about 90°; and a combiner configured to combine received signals into a single signal and provide the single signal to a receiver.

2. The array antenna of claim 1 wherein the at least two antenna elements include at least one patch antenna element.

3. The array antenna of claim 1 wherein the at least two antenna elements include at least one linear antenna element.

4. The array antenna of claim 1 wherein the at least two antenna elements are substantially aligned.

5. The array antenna of claim 1 wherein the at least two antenna elements include more than one driven antenna element each of which is fed in-phase.

6. The array antenna of claim 1 wherein the at least two antenna elements include one or more parasitic antenna elements, the one or more parasitic antenna elements being free from connection to other circuitry.

7. A patch array antenna comprising:

at least two antenna elements, each antenna element of the at least two antenna elements being axially-aligned and axially-spaced by about λ/4 from adjacent ones of the at least two antenna elements, wherein polarization diversity is provided by one or more driven antenna elements of the at least two antenna elements, each of the one or more driven antenna elements providing horizontal and vertical polarizations, each of the one or more driven antenna elements including one or more feed points for the horizontal polarization and one or more feed points for the vertical polarization; and a switching circuit configured to switch between the one or more feed points to alternately provide the horizontal and vertical polarizations.

8. The patch array antenna of claim 7 wherein the at least two antenna elements are substantially aligned.

9. The patch array antenna of claim 7 wherein the at least two antenna elements include one or more linear antenna elements.

10. The patch array antenna of claim 7 further comprising a phase shifter configured to shift the phase of at least one signal so that signals from adjacent ones of the at least two antenna elements are shifted by about 90°.

11. The patch array antenna of claim 7 further comprising a combiner configured to combine received signals into a single signal and provide the single signal to a receiver.

12. The patch array antenna of claim 7 wherein the at least two antenna elements include one or more parasitic antenna elements, the one or more parasitic antenna elements being free from connection to other circuitry.

13. A linear array antenna comprising:

at least two antenna elements, each antenna element of the at least two antenna elements being axially-aligned, axially-spaced, and including a number of substantially linear conductive segments forming a loop, wherein polarization diversity is provided by at least one driven antenna element of the at least two antenna elements, the at least one driven antenna element providing horizontal and vertical polarizations, the at least one driven element including one or more feed points for the horizontal polarization and one or more feed points for the vertical polarization;

a plurality of inductors each disposed at a corner of the loop; and a switching circuit configured to switch between the one or more feed points to alternately provide the horizontal and vertical polarizations.

14. The linear array antenna of claim 13 wherein each antenna element of the at least two antenna elements is spaced by about λ/4 from adjacent ones of the at least two antenna elements.

15. The linear array antenna of claim 13 further comprising transmission lines extending between terminals of the switching circuit and the one or more feed points.

16. The linear array antenna of claim 13 wherein the at least two antenna elements are substantially aligned.

17. The linear array antenna of claim 13 wherein the at least two antenna elements include one or more patch antenna elements.

18. The linear array antenna of claim 13 further comprising a phase shifter configured to shift the phase of at least one signal so that signals from adjacent ones of the at least two antenna elements are shifted by about 90°.

19. The linear array antenna of claim 13 further comprising a combiner configured to combine received signals into a single signal and provide the single signal to a receiver.

20. The linear array antenna of claim 13 wherein the at least two antenna elements include one or more parasitic antenna elements, the one or more parasitic antenna elements being free from connection to other circuitry.

* * * * *